United States Patent [19]

Thornthwaite et al.

[11] Patent Number: 4,759,694

[45] Date of Patent: Jul. 26, 1988

[54] LIQUID FUEL PUMPING APPARATUS

[75] Inventors: Ian R. Thornthwaite, Rainham; Paul R. Smith, Chaltham, both of England

[73] Assignee: Lucas Industries, Birmingham, England

[21] Appl. No.: 50,714

[22] Filed: May 14, 1987

[30] Foreign Application Priority Data

May 23, 1986 [GB] United Kingdom ..... 8612622

[51] Int. Cl.[4] ..... F04B 19/00; F04B 29/00; F02M 41/14

[52] U.S. Cl. ..... 417/462; 123/450

[58] Field of Search ..... 417/462; 123/450

[56] References Cited

U.S. PATENT DOCUMENTS

| | | | |
|---|---|---|---|
| 3,485,225 | 12/1969 | Bailey | 123/450 |
| 4,362,141 | 12/1982 | Mowbray | 123/450 |
| 4,462,370 | 7/1984 | Jarret | 417/462 |
| 4,572,138 | 2/1986 | Mowbray | 417/462 |

FOREIGN PATENT DOCUMENTS

| | | | |
|---|---|---|---|
| 2071874A | 9/1981 | United Kingdom | 123/450 |

*Primary Examiner*—William L. Freeh

*Attorney, Agent, or Firm*—Balogh, Osann, Kramer, Dvorak, Genova & Traub

[57] ABSTRACT

A liquid fuel pumping apparatus of the rotary distributor type has a rotary distributor which is also axially movable to determine the quantity of fuel supplied by the apparatus. Inclined stop surfaces are provided to limit the outward movement of the pumping plungers during the filling strokes and an axial reaction is applied to the distributor member when the surfaces engage. The axial position of the distributor member is controlled by applying fluid pressure to one end thereof, the fluid being supplied to a chamber. A supply passage to the chamber includes a check valve and escape of fluid from the chamber is controlled by a sleeve which covers a port. When the axial reaction is applied the port is closed by the sleeve and the check valve closes to form a hydraulic lock.

11 Claims, 2 Drawing Sheets

LIQUID FUEL PUMPING APPARATUS

Figure 1:
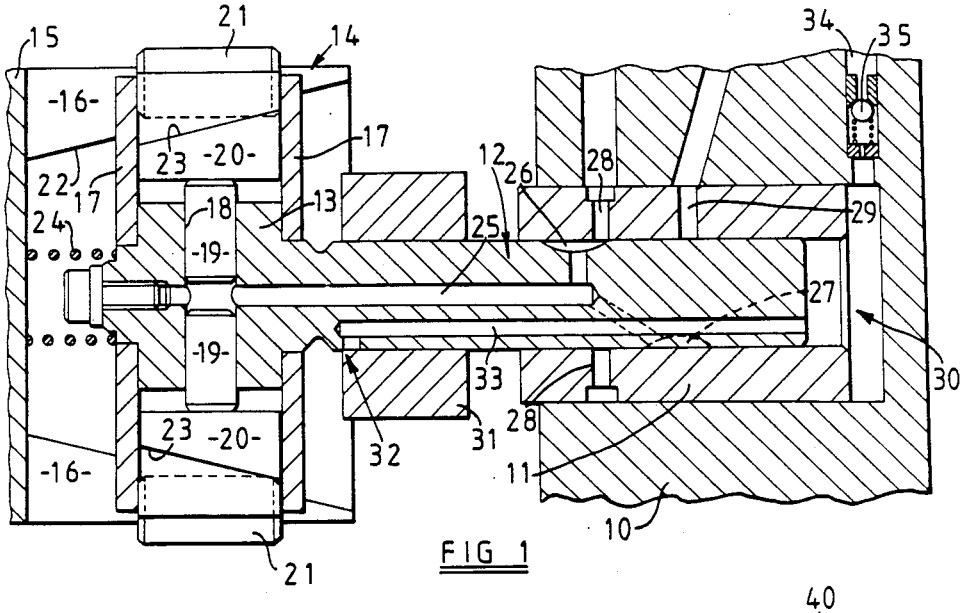

This invention relates to liquid fuel pumping apparatus of the kind comprising a rotatable and axially movable distributor member housed within a body, a reciprocable pump plunger housed within a bore formed in the distributor member, cam means mounted in the body for effecting inward movement of the plunger as the distributor member rotates, passage means in the distributor member and body through which fuel can flow to the bore to effect outward movement of the plunger and through which fuel can flow to an outlet during inward movement of the plunger by the cam means, inclined stop surfaces defined on a part carried by the distributor member and a part housed within the body, said stop surfaces co-operating to limit the extent of outward movement of the plunger and thereby the quantity of fuel supplied through the outlet in accordance with the axial position of the distributor member, resilient means biasing the distributor member in the direction to increase the amount of fuel flow through the outlet, a chamber defined in the body, said distributor member or a part coupled thereto, extending into the chamber and being subject to the pressure in said chamber whereby an increase in the pressure in the chamber will cause movement of the distributor member against the action of the resilient means in a direction to reduce the amount of fuel delivered through said outlet and means for controlling the pressure of liquid in said chamber.

A known method of controlling the pressure in the chamber is to provide a sleeve on the distributor member or said part, the sleeve being axially movable and controlling the opening of a port which is connected to the chamber and through which liquid can escape from the chamber. Providing the port is correctly positioned relative to the sleeve it can be arranged that the initial axial movement imparted to the distributor as a result of engagement of said stop surfaces, will cause closure of said port and therefore prevent the escape of liquid from said chamber through the port. It is however necessary to supply liquid to said chamber through a flow path from a source of liquid and in order to achieve a hydraulic lock in the chamber so as to minimise movement of the distributor member it is necessary to prevent liquid flow along said flow path.

The object of the present invention is to provide an apparatus of the kind specified in a simple and convenient form.

According to the invention a liquid fuel pumping apparatus of the kind specified comprises a port formed on the periphery of the distributor member or on a part connected thereto, an axially movable sleeve on the distributor member or said part, said sleeve controlling the flow of liquid through said port from said chamber and the relative position of the sleeve and port being such that axial movement of the distributor member due to the interaction of said stop surfaces will cause closure of said port, a liquid supply path to said chamber and valve means in said supply path, said valve means being arranged to prevent flow of liquid along said supply path from the chamber.

Examples of fuel pumping apparatus in accordance with the invention will now be described with reference to the accompanying drawings in which:

FIG. 1 is a sectional side elevation of a portion of the apparatus in accordance with the invention, and FIGS. 2–5 show modifications to the example seen in FIG. 1.

Referring to FIG. 1 of the drawings the apparatus comprises a body 10 in which is fixed a sleeve 11, the sleeve mounting a rotary distributor member 12 which projects from the sleeve and which has an enlarged portion 13.

Surrounding the enlarged portion 13 is an annular member 14 which is integral with a drive shaft 15 adapted in use to be driven in timed relationship with the associated engine. The part 14 is provided with a pair of axially extending slots 16 in which is located a pair of drive plates 17 coupled to the distributor member on opposite sides of the enlarged portion 13 thereof.

Formed in the enlarged portion 13 of the distributor member is a transversely extending bore 18 in which is mounted a pair of pumping plungers 19. At their outer ends the plungers engage shoes 20 respectively which form part of a pair of cam followers, the cam followers further including rollers 21 which are located within grooves formed in the outer surfaces of the shoes. The shoes and rollers are located against axial movement by reason of the fact that they are located between the drive plates 17. Moreover, the rollers 21 project through the slots 16 into engagement with the internal peripheral surface of a cam ring not shown, the cam ring defining a plurality of cam lobes which as the distributor member rotates, will engage the rollers to impart inward movement to the plungers 19.

The internal surface 22 of the part 14 is flared outwardly to define a stop surface for co-operation with stop surfaces 23 formed on the shoes 20. The distributor member is biased towards the right as seen in the drawing by means of a coiled compression spring 24.

Communicating with the bore 18 is a longitudinal drilling 25 which communicates with a first longitudinal groove 26 formed on the periphery of the distributor member and a further longitudinal groove 27 also formed on the periphery of the distributer member at an axially spaced position. The groove 26 can register in turn with a plurality of inlet ports 28 which are connected to a source of fuel under pressure conveniently a low pressure pump driven by the drive shaft 15. The groove 27 can register in turn with outlet ports 29, only one of which is shown, formed in the sleeve and connected to outlets on the body to which, in use, the injection nozzles respectively of the associated engine are connected. The communication of the groove 27 with an outlet 29 is arranged to take place just before the plungers 19 are moved inwardly by the cam lobes and during such inward movement fuel will be displaced through one of the outlets to a combustion chamber of the associated engine. As the distributor member continues to rotate the groove 26 will be brought into register with a port 28, the groove 27 moving out of register with a port 29. Fuel can now flow to the bore 18 to effect outward movement of the plungers 19 and the cam followers. The extent of outward movement is limited by the engagement of the stop surfaces 23 with the stop surface 22. As the distributor member continues to rotate the groove 26 will move out of register with the port 28 and the groove 27 will move into register with the next outlet 29. Thereafter the cycle of operations as described is repeated with fuel being supplied to the combustion chambers of the engine in turn.

The extent of outward movement of the plungers determines the amount of fuel which is supplied to the engine and by moving the distributor so the quantity of fuel can be varied.

As described above the distributor member is biased towards the right by the action of the spring 24 in other words, the distributor member will move in a direction to increase the amount of fuel supplied to the engine. This movement of the distributor member is opposed by the fuel pressure within a chamber 30 defined in the body and into which the end of the distributor member remote from the spring projects.

The escape of fuel from the chamber 30 is controlled by means of a sleeve 31 which is mounted about the distributor member and is axially movable relative thereto. The sleeve in use will be connected to a speed governor mechanism. The sleeve controls the opening of a port 32 formed in the distributor member and connected by means of a passage 33 with the chamber 30. Fuel is supplied to the chamber from a source of liquid conveniently the aforesaid low pressure pump, by way of a supply path 34 and located in the supply path is a spring loaded check valve 35. In use, as the sleeve is moved towards the right, the port 32 will be uncovered and this will allow fuel to escape from the chamber 30 causing a reduction of pressure therein. The distributor member will therefore move towards the right tending to reclose the port 32. Fuel is supplied to the chamber through the flow path 34 the fuel flow causing the valve member of the check valve to be lifted from its seating. The flow through the flow path is at a restricted rate so that in practice the distributor member will assume an equilibrium position with the port 32 slightly open. When, during the operation of the apparatus, the stop surfaces 23 engage the stop surface 22 a reaction force is applied to the distributor member which tends to urge it towards the right. Such movement will cause closure of the port 32 and also closure of the valve 35 so that an hydraulic lock will be created in the chamber 30 which will prevent further movement of the distributor member.

Figure 2:
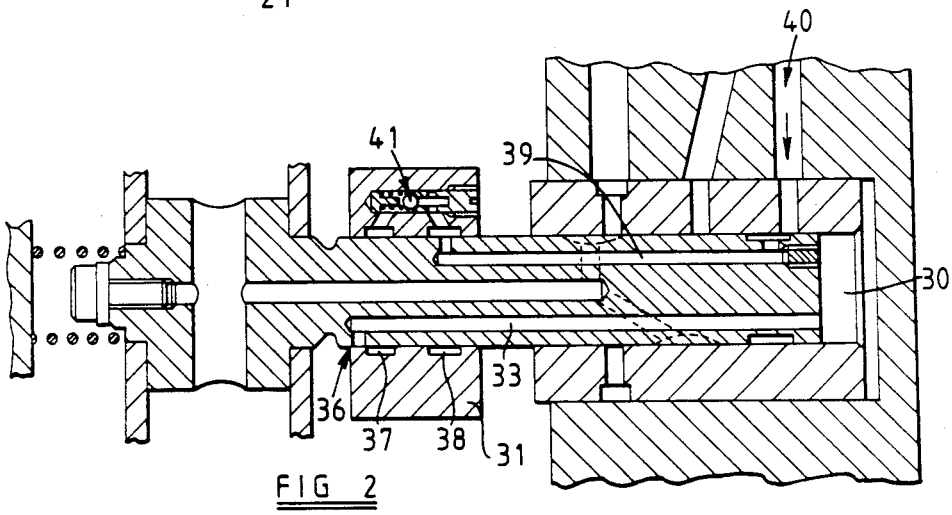

Referring now to FIG. 2, the general details of the appartus are as with the example of FIG. 1 and the escape of fuel from the chamber 30 takes place by way of the passage 33 and the port 36 as in the previous example. The flow path of fuel to the chamber does however include the port 36 and the passage 33 and as will be seen from FIG. 2 the sleeve 31 is provided with two circumferential grooves 37, 38 on the internal surface of the sleeve. The groove 38 is in permanent communication by way of a passage 39 in the distributor member, with a supply passage 40 in the body. The grooves 37 and 38 are interconnected through a non-return valve 41 which is disposed to allow flow of fuel from the groove 38 to the groove 37 but to prevent flow in the opposite direction.

In operation, as the sleeve is moved towards the right as seen in FIG. 2, the port 36 will be uncovered to a space in the body and fuel will escape from the chamber 30 allowing the distributor member to move towards the right until the port 36 is again covered. If the sleeve is moved towards the left as seen in FIG. 1, the port 36 is opened to the groove 37 and fuel can flow past the valve 41 to the groove 37 and hence through the port 36 into the chamber 30. As a result the distributor member will also move towards the left until the port 36 is again covered. The width of the land defined by the sleeve and which controls the port is only slightly wider than the diameter of the port and when the distributor member has the aforesaid force applied to it when the stop surfaces engage with each other, the port will tend to be uncovered to the groove 37. In this situation however the flow of fuel from the chamber is prevented by the action of the valve 41.

Figure 3:
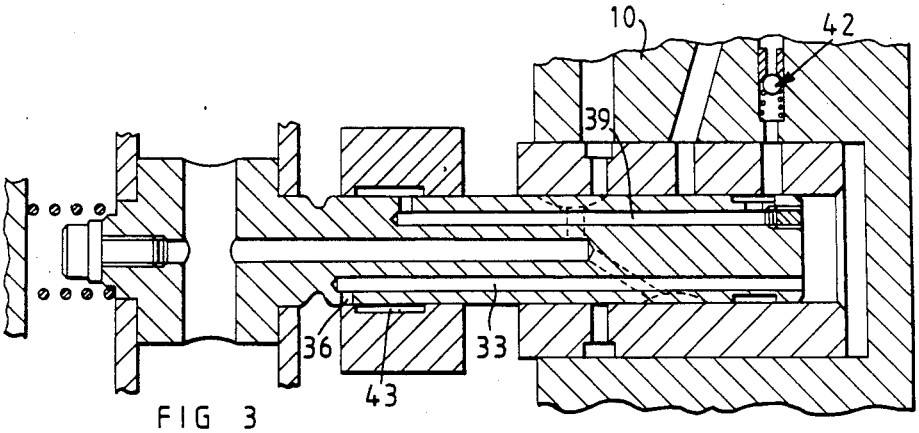

The arrangment shown in FIG. 3 is substantially identical to the arrangement shown in FIG. 2 with the exception that the non-return valve indicated at 42, is located in the body 10 of the apparatus and the two grooves 37, 38 are replaced by a single groove 43.

Figure 4:
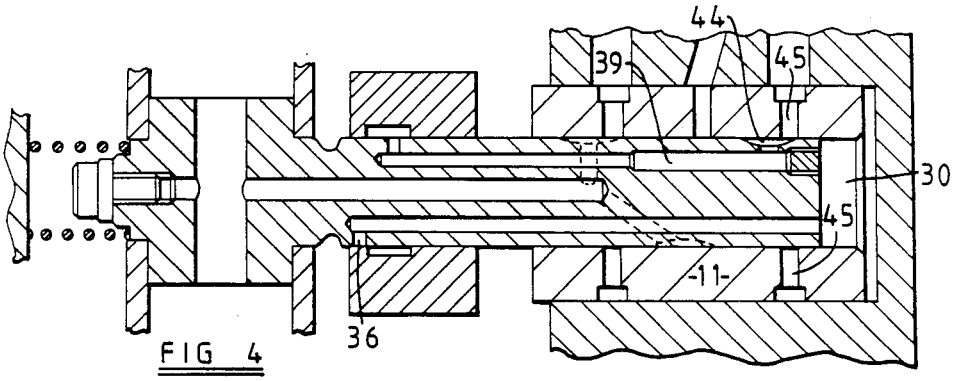

Turning now to FIG. 4, the function of the valve 42 is replaced by a groove 44 on the periphery of the distributor member and which is connected to the passage 39. The groove 44 is positioned to register with a series of supply ports 45 formed in the sleeve 11 and which are connected to the aforesaid low pressure pump. It is arranged that the groove 44 can communicate with a port 45 for a limited period following delivery of fuel and before there is any chance of the stop faces 23 and 22 moving into engagement with each other whatever the axial setting of the distributor member. Thus a hydraulic lock will be created in the chamber 30 as with the example of FIG. 3.

Figure 5:
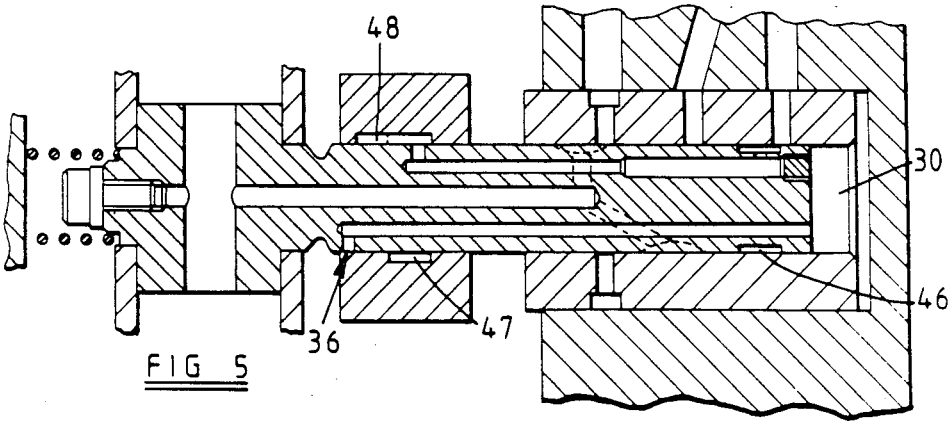

In the example of FIG. 5 the groove 44 is omitted and is replaced by a circumferential groove 46 which is in constant communication with the fuel supply. In this example the port 36 is prevented from communicating with the chamber 30 except immediately following delivery of fuel and before there is a chance of the stop surfaces engaging with each other. For this purpose the circumferential groove 47 formed on the internal surface of the sleeve is provided with a plurality of grooves 48 which will be exposed to the port 36 in turn when the sleeve is moved towards the left to reduce the amount of fuel supplied to the associated engine. Again an hydraulic lock is created at the instant when the stop surfaces engage with each other.

We claim:

1. A liquid fuel pumping apparatus comprising a rotatable and axially movable distributor member housed within a body, a reciprocable plunger housing within a bore formed in the distributor member, cam means mounted in the body for effecting inward movement of the plunger as the distributor member rotates, passage means in the distributor member and body through which fuel can flow to the bore to effect outward movement of the plunger by the cam means, inclined stop surfaces defined on a part carried by the distributor member and a part housed within the body, said stop surfaces co-operating to limit the extent of outward movement of the plunger and thereby the quantity of fuel supplied through the outlet in accordance with the axial position of the distributor member, resilient means biasing the distributor member in the direction to increase the amount of fuel flow through the outlet, a chamber defined in the body, said distributor member extending into the chamber and being subject to the pressure in said chamber whereby an increase in the pressure in the chamber will cause movement of the distributor member against the action of the resilient means in a direction to reduce the amount of fuel delivered through said outlet, a port formed on the periphery of the distributor member, passage means connecting said port with said chamber, an axially movable sleeve on the distributor member, said sleeve controlling the flow of liquid through said port and the relative position of the sleeve and port being such that axial movement of the distributor member due to the interaction of said stop surfaces will cause closure of said port to prevent the escape of liquid from the chamber, a liquid supply path to said chamber and a non-return valve in said supply path, said non-return valve being arranged to allow the flow of liquid along said supply path to increase the pressure in said chamber but preventing flow of liquid along said supply path from the chamber.

2. An apparatus according to claim 1 in which said supply path comprises a passage in the body communicating directly with said chamber, said non-return valve being postioned in said passage.

3. An apparatus according to claim 2 in which said valve means comprises a spring loaded check valve.

4. An apparatus according to claim 1 in which said non-return valve comprises a spring loaded check valve.

5. An apparatus according to claim 1 in which said supply path includes said port, said sleeve having a circumferential groove formed on its internal peripheral surface, the groove defining a land with an end surface of the sleeve, said land being positioned to obturate said port, and the groove forming part of the liquid supply path to said chamber.

6. An apparatus according to claim 5 in which said valve means comprises a spring loaded check valve.

7. An apparatus according to claim 5 in which said supply path includes a further groove on the internal peripheral surface of said sleeve, the non-return valve being located in a passage in the sleeve connecting the two grooves, and passage means in the distributor member and body for connecting said further groove to a source of liquid under pressure.

8. An apparatus according to claim 7 in which said valve means comprises a spring loaded check valve.

9. An apparatus according to claim 5 including passage means in the distributor member and body for connecting said groove with a source of liquid, said non-return valve being located in the body.

10. An apparatus according to claim 9 in which said valve means comprises a spring loaded check valve.

11. A liquid fuel pumping apparatus comprising a rotatable and axially movable distributor member housed within a body, a reciprocable pump plunger housed within a bore formed in the distributor member, cam means mounted in the body for effecting inward movement of the plunger as the distributor member rotates, passage means in the distributor member and body through which fuel can flow to the bore to effect outward movement of the plunger and through which fuel can flow to an outlet during inward movement of the plunger by the cam means, inclined stop surfaces defined on a part carried by the distributor member and a part housed within the body, said stop surfaces cooperating to limit the extent of outward movement of the plunger and thereby the quantity of fuel supplied through the outlet in accordance with the axial position of the distributor member, resilient means biasing the distributor member in the direction to increase the amount of fuel flow through the outlet, a chamber defined in the body, said distributor member or a part coupled thereto, extending into the chamber and being subject to the pressure in said chamber whereby an increase in the pressure in the chamber will cause movement of the distributor member against the action of the resilient means in a direction to reduce the amount of fuel delivered through said outlet, means for controlling the pressure of liquid in said chamber, a port formed on the periphery of the distributor member or on a part connected thereto, an axially movable sleeve on the distributor member or said part, said sleeve controlling the flow of liquid through said port from said chamber and the relative position of the sleeve and port being such that axial movement of the distributor member due to the interaction of said stop surfaces will cause closure of said port, a liquid supply path to said chamber and valve means in said supply path, said valve means being arranged to prevent flow of liquid along said supply path from the chamber, said supply path includes said port, said sleeve having a circumferential groove formed on its internal peripheral surface, the groove defining a land with an end surface of the sleeve, said land being positioned to obturate said port, and the groove forming part of the liquid supply path to said chamber, said valve means comprises a spring loaded check valve.

* * * * *